US009574485B2

(12) United States Patent
Fournier et al.

(10) Patent No.: US 9,574,485 B2
(45) Date of Patent: Feb. 21, 2017

(54) MECHANICAL COOLANT PUMP

(71) Applicant: PIERBURG PUMP TECHNOLOGY GMBH, Neuss (DE)

(72) Inventors: Arnaud Fournier, Yutz (FR); Gerald Picco, Braumont (FR); Damien Charpentier, Somy Amandy (FR)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 121 days.

(21) Appl. No.: 14/436,483

(22) PCT Filed: Oct. 19, 2012

(86) PCT No.: PCT/EP2012/070738

§ 371 (c)(1),
(2) Date: Apr. 17, 2015

(87) PCT Pub. No.: WO2014/060041

PCT Pub. Date: Apr. 24, 2014

(65) Prior Publication Data

US 2015/0337715 A1 Nov. 26, 2015

(51) Int. Cl.
*F01P 5/10* (2006.01)
*F01P 7/14* (2006.01)
(Continued)

(52) U.S. Cl.
CPC *F01P 5/10* (2013.01); *F01P 7/14* (2013.01); *F01P 7/16* (2013.01); *F04D 15/0016* (2013.01);
(Continued)

(58) Field of Classification Search
CPC ..... F04D 1/00; F04D 1/04; F04D 15/0005; F04D 15/0016; F04D 15/0022;
(Continued)

(56) References Cited

U.S. PATENT DOCUMENTS

2003/0143084 A1 7/2003 Repple et al.
2012/0192816 A1 8/2012 Simon et al.
2013/0011250 A1 1/2013 Fournier et al.

FOREIGN PATENT DOCUMENTS

CN 1732336 A 2/2006
DE 10 2007 023 858 A1 11/2008
(Continued)

*Primary Examiner* — Craig Kim
*Assistant Examiner* — Brian P Wolcott
(74) *Attorney, Agent, or Firm* — Norman B. Thot

(57) ABSTRACT

A mechanical coolant pump for an internal combustion engine includes an impeller pump wheel. The pump housing comprises an outlet valve arrangement arranged between an outlet volute and a pump outlet, and a support portion. The pump housing closes and/or opens a valve opening. The outlet valve arrangement comprises a valve body which pivots. The valve body comprises a closing element which covers the valve opening, and first and second end disks. The closing element comprises an opening seat in a closed valve position. The first and second end disks are parallel to each other, are arranged at opposite axial ends of, and perpendicular to, the closing element, and rotate around a pivot axis. The first and second end disks each comprise a radial clamping nose which acts with the support portion to radially push the closing element against the opening seat in a closed valve position.

9 Claims, 6 Drawing Sheets

(51) Int. Cl.
*F01P 7/16* (2006.01)
*F04D 29/46* (2006.01)
*F04D 15/00* (2006.01)

(52) U.S. Cl.
CPC ..... *F04D 15/0022* (2013.01); *F04D 29/468* (2013.01); *F01P 2007/146* (2013.01)

(58) Field of Classification Search
CPC ..... F04D 29/46; F04D 29/466; F04D 29/468; F01P 5/10; F01P 11/00; F01P 7/16; F01P 2007/146; F01P 7/14
USPC ..... 251/162, 309–312; 137/625.19, 625.46, 137/625.47
See application file for complete search history.

(56) References Cited

FOREIGN PATENT DOCUMENTS

| | | | |
|---|---|---|---|
| EP | 2 299 084 | A1 | 3/2011 |
| JP | 48-104103 | A | 12/1973 |
| JP | 61-52469 | A | 3/1986 |
| JP | 4-237898 | A | 8/1992 |
| WO | WO 2010/146609 | A1 | 12/2010 |
| WO | WO 2011/095907 | A1 | 8/2011 |
| WO | WO 2011/101019 | A1 | 8/2011 |

MECHANICAL COOLANT PUMP

CROSS REFERENCE TO PRIOR APPLICATIONS

This application is a U.S. National Phase application under 35 U.S.C. §371 of International Application No. PCT/EP2012/070738, filed on Oct. 19, 2012. The International Application was published in English on Apr. 24, 2014 as WO 2014/060041 A1 under PCT Article 21(2).

FIELD

The present invention relates to a mechanical coolant pump for an internal combustion engine. A mechanical coolant pump is driven by the combustion engine, for example, by using a driving belt driving a driving wheel of the pump, so that the rotational speed of the coolant pump is proportional to the rotational speed of the combustion engine. As long as the combustion engine is cold, no coolant flow is needed. Mechanical coolant pumps can therefore be provided with an outlet valve arrangement for controlling the coolant flow leaving the coolant pump. As long as the combustion engine is cold, the outlet valve is closed so that the circulation of the lubricant is reduced, minimized, or completely stopped, with the result that the combustion engine's warming-up phase is shortened and the energy consumption of the coolant pump is reduced.

BACKGROUND

WO 2011/101019 A1 describes an impeller-type mechanical coolant pump with an outlet valve arrangement between the outlet volute and the pump outlet. When the valve is closed, the coolant delivery is more or less completely stopped because a high closing force is generated by the coolant pressure and allows high valve sealing forces. High opening forces are, however, needed to open the valve flap against the pressure of the coolant pushing the valve flap in the closed position.

SUMMARY

An aspect of the present invention is to provide a mechanical coolant pump for an internal combustion engine with an outlet valve arrangement having a good long-term coolant tightness of the closed valve and where low actuation forces are needed to open and to close the valve body.

In an embodiment, the present invention provides a mechanical coolant pump for an internal combustion engine which includes an outlet volute, a pump outlet, an impeller pump wheel configured to pump an incoming liquid coolant in an axial direction radially into the outlet volute to the pump outlet, and a pump housing defining the outlet volute. The pump housing comprises an outlet valve arrangement fluidically arranged between the outlet volute and the pump outlet and a support portion. The pump housing is configured to at least one of close and to open a valve opening. The outlet valve arrangement comprises a valve body configured to pivot. The valve body comprises a closing element configured to directly cover the valve opening, a first end disk, and a second end disk. The closing element comprises an opening seat in a closed valve position. The first end disk and the second end disk are configured to be parallel to each other and are arranged at opposite axial ends of, and perpendicular to, the closing element. The first end disk and the second end disk are arranged so as to rotate around a pivot axis which is perpendicular to each of the first end disk and the second end disk. Each of the first end disk and the second end disk comprises a radial clamping nose configured to act together with the support portion of the pump housing to radially push the closing element against the opening seat in a closed valve position.

BRIEF DESCRIPTION OF THE DRAWINGS

The present invention is described in greater detail below on the basis of embodiments and of the drawings in which.

DETAILED DESCRIPTION

Figure 1:
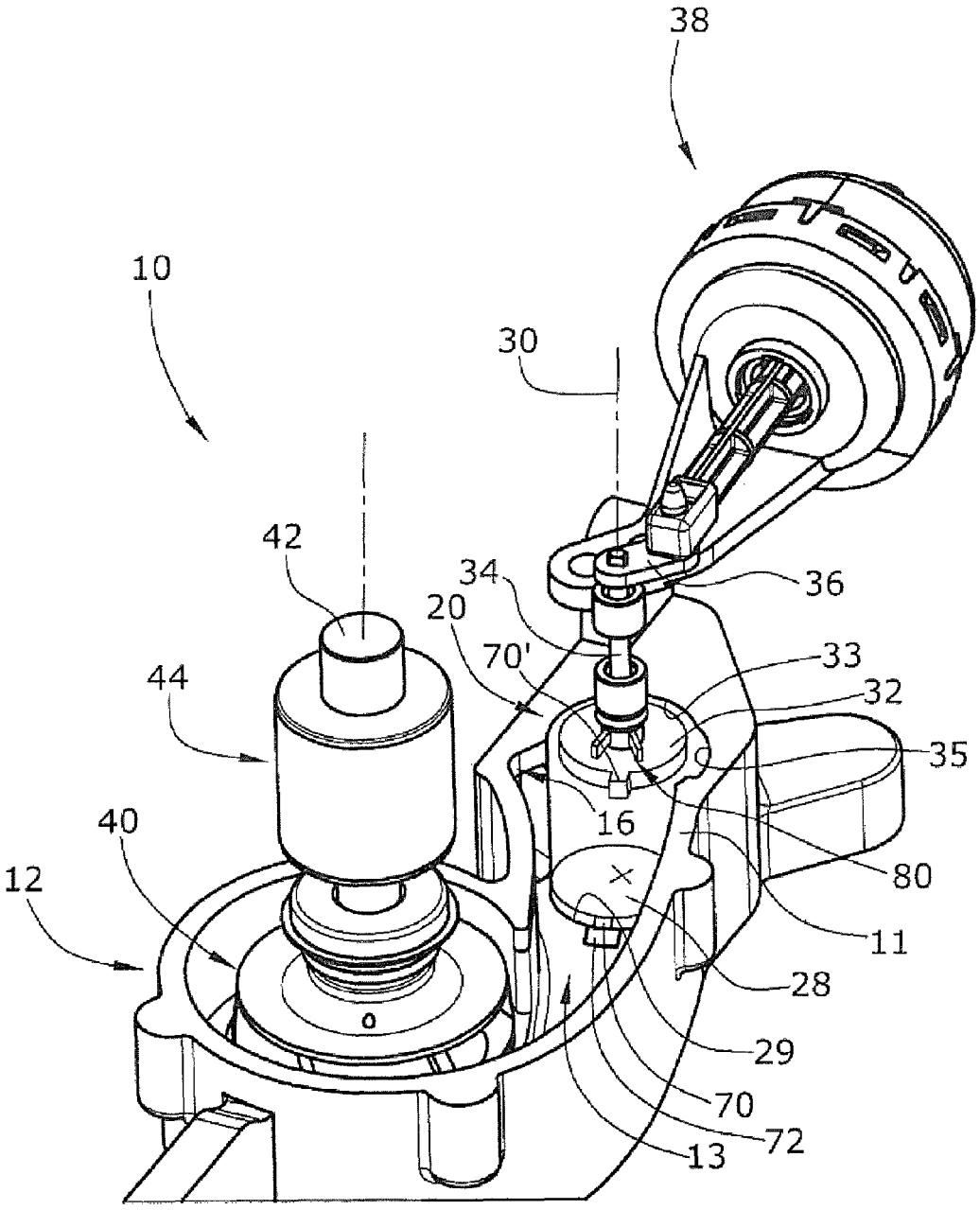
FIG. 1 shows a perspective view of a mechanical coolant pump including an outlet valve arrangement without a cover lid.
Figure 2:
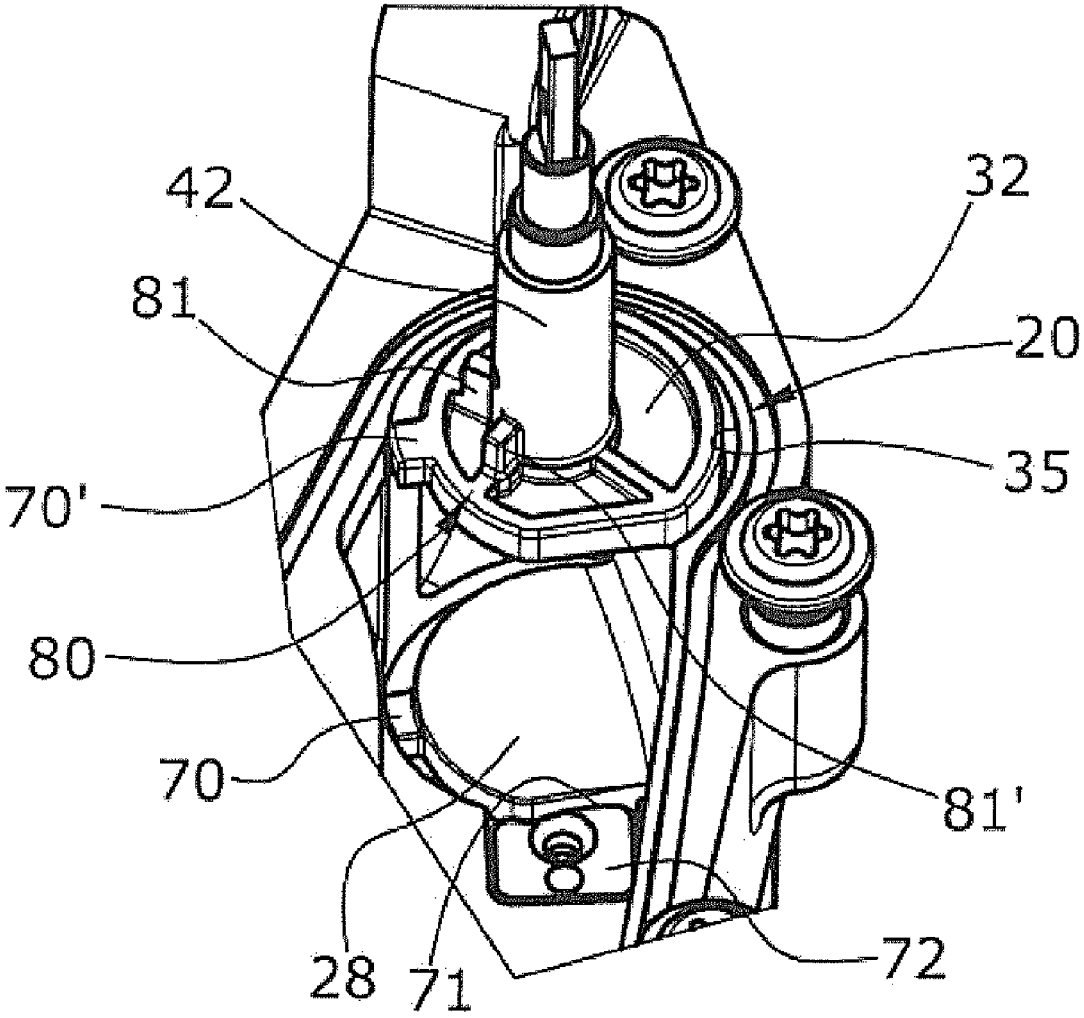
FIG. 2 shows an enlarged perspective view of the outlet valve arrangement of FIG. 1 in the open valve position.
Figure 3:
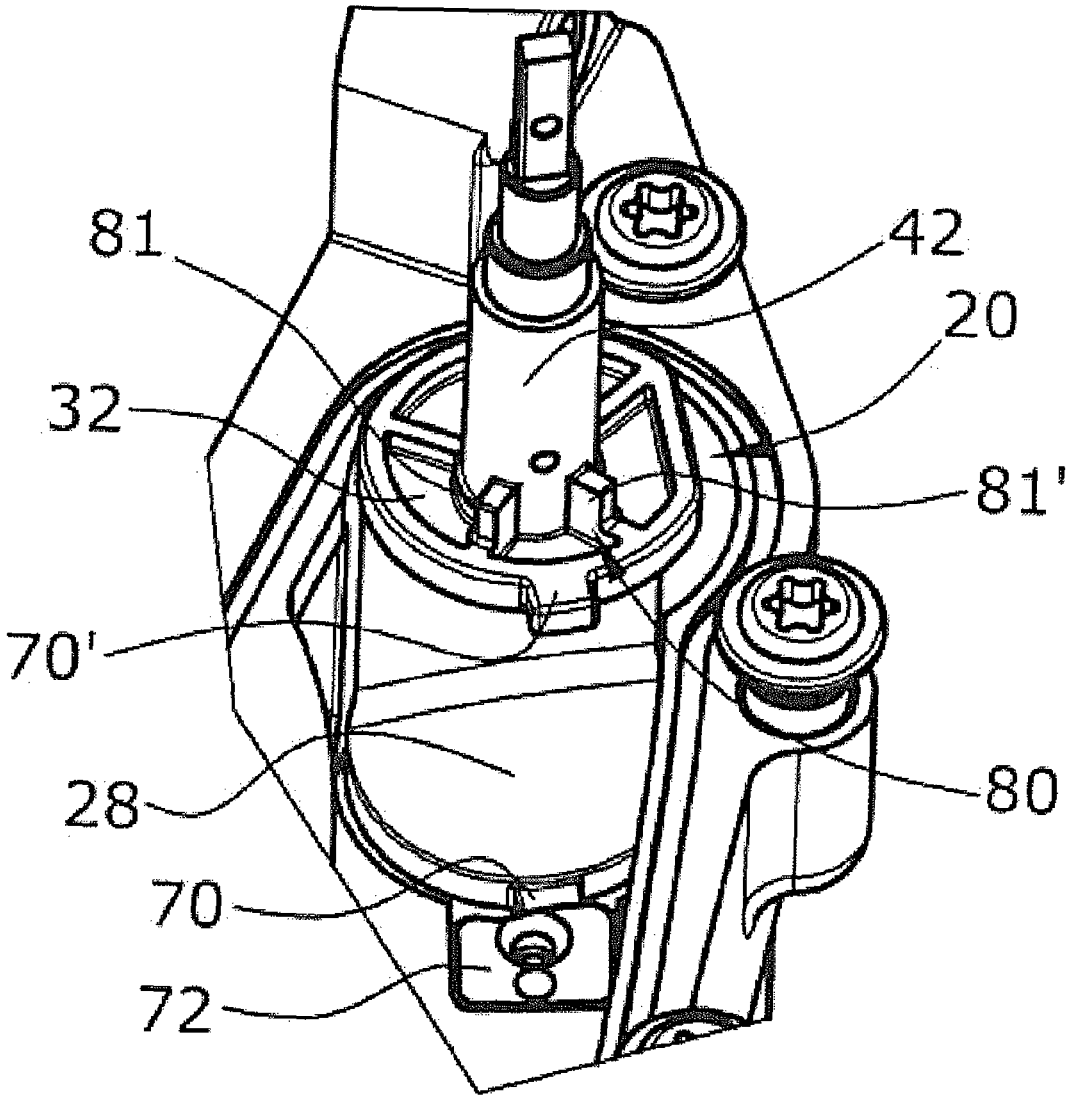
FIG. 3 shows an enlarged perspective view of the outlet valve arrangement of FIG. 1 in the closed valve position.

The mechanical coolant pump of the present invention is provided with an impeller pump wheel which pumps the liquid coolant incoming in the axial direction radially into an outlet volute. The outlet volute is defined by the pump housing, which also defines a pump outlet including an outlet channel and a pump outlet opening. The outlet volute is the coolant space around the pump wheel, whereas the outlet channel is the coolant conduit between the outlet volute and the pump outlet opening. The mechanical coolant pump is provided with an outlet valve arrangement fluidically arranged between the outlet volute and the pump outlet for closing or opening a valve opening. The valve opening can, for example, be arranged between the outlet volute and the outlet channel, but can be arranged everywhere in the coolant-leading room between the pump wheel and the pump outlet.

The outlet valve arrangement comprises a pivotable valve body comprising a closing element. In the closed valve position, the closing element directly covers the valve opening being provided with an opening seat on which the closing element's edge is seated. The valve body is provided with two end disks at the axial ends of the closing element, whereby the general planes of the closing element and of the valve opening are orientated substantially perpendicular to the general plane of the two end disks. The end disks are supported by suitable bearings with respect to the pump housing so that the valve body is pivotable around the pivot axis which is in parallel to the general planes of the closing element and the valve opening. The pivot axis does not lie in the general plane of the valve opening, but more or less lies in the middle of the end disks. The center pivot axis also lies within the projection of the valve opening and can, for example, lie symmetrically in the middle of the valve openings projection.

The closing element is more or less only shifted along a circle line between the open position and the closed position. The actuation forces for opening and closing the valve body are therefore relatively low because the lever arm of the coolant pressure acting against the closing element is always relatively short.

In an embodiment of the present invention, the valve body can, for example, have the geometry of a hollow cylindrical body, whereby the plane cylinder end walls are defined by the end disks and a sector of the cylinder defines the closing element and also defines the valve opening plane. While the valve body is not necessarily one single piece, it is an integral part comprising the closing element and the two end disks.

Both end disks are provided with respective radial clamping noses which respectively act together with a corresponding support portion of the pump housing. In the closed valve position, the radial clamping noses are radially supported and pushed by the corresponding housing support portions to radially push the closing element against the valve seat of the valve opening. The valve body bearings can be provided with a minimum radial play to allow a minimum radial movement of the valve body. Since the closing element is mechanically pushed against the valve seat in the closed valve position, a coolant-tight closing of the valve opening is provided even if the valve seat and/or the corresponding closing element edge or an elastic sealing at the closing element edge is significantly worn down.

In the open valve position, the clamping nose and the corresponding support portion do not interact with each other so that the rotational friction forces and the corresponding valve actuation forces are minimized.

The present invention provides a combination of low actuation forces, which allows for the use of a relatively small actuator, and high closing quality, which speeds up the engine's warming after a cold start.

In an embodiment of the present invention, the clamping noses can, for example, be arranged radially opposite to the closing element, or more precisely, the axial center line of the closing element is arranged more or less exactly opposite to the clamping noses with reference to the pivot axis of the valve body. The radial forces caused by the clamping noses and the corresponding support portion are thereby spread equally over the entire closing element's edge and the corresponding valve seat.

In an embodiment of the present invention, the support portion can, for example, be defined by a separate support element which is mounted to the pump housing. The pump housing can be made of plastic, aluminum, or another material which is light but not sufficiently wear-resistant. The separate support elements can be made of a hard material which is wear-resistant so that the clamping forces and the resulting coolant tightness remain high even after a long lifetime.

In an embodiment of the present invention, the radial position of the support element can, for example, be provided so as to be adjustable with respect to the pump housing within a relatively small but sufficient range. This allows for the adaption of the radial position of the support element to the needed clamping forces and/or allows for a correction of mechanical inaccuracies.

In an embodiment of the present invention, a second pump outlet can, for example, be provided which is arranged so as to be fluidically parallel to the first pump outlet. The second pump outlet is not directly affected by the valve arrangement so that coolant is always provided through the second pump outlet as long as the impeller pump wheel rotates. The first outlet can, for example, be provided to supply the engine with coolant. The second pump outlet can, for example, be provided to supply an exhaust gas recirculation cooler with the coolant. An exhaust gas recirculation cooler warms up much faster than the engine itself after the cold engine has been started. Even in the engine's warm-up phase, the exhaust gas can become very hot so that the exhaust gas recirculation cooler needs to be cooled by the liquid coolant even if the engine itself has not reached its working temperature.

In an embodiment of the present invention, the pump housing can, for example, be provided with a, for example, circular recess for recessing and embedding the two corresponding end disks so that the proximal surface of the end disks and of the pump housing define a stepless surface with a low fluidic resistance.

In an embodiment of the present invention, the valve body pivot axis can, for example, be provided within the part of the outlet volute which is the fluidic channel right before the outlet valve arrangement. The proximal surface of the closing element is distant from the pivot axis with an offset distance of minimally one fourth of the maximum outside radius of the cylinder embedding the valve body. The distal closing element surface is the surface which face the pump outlet in the closed valve body position. The proximal closing element surface is opposite the distal closing element surface.

In an embodiment of the present invention, the pump housing can, for example, be provided with a recess for recessing the closing element in the open valve position. By housing and recessing the closing element in the corresponding recess, a more or less stepless surface in the corresponding volute wall is defined when the valve body is in its open position so that a relatively low flow resistance for the coolant is realized.

One embodiment of a mechanical coolant pump according to the present invention is hereinafter described under reference to the drawings.

FIGS. 1 to 6 show a mechanical coolant pump 10 for circulating a coolant in two separate parallel coolant circuits of an internal combustion engine. The first coolant circuit can be arranged in the engine block itself, and the second coolant circuit can be a heat exchanger of another device related to the engine, for example, of an exhaust gas recirculation cooler, an oil cooler, an exhaust gas cooler etc. The coolant pump 10 is provided with a driving wheel 44 which can be driven by a driving belt which is directly driven by the internal combustion engine. The driving wheel 44 and an impeller pump wheel 40 are connected to each other by a rotor (or valve) shaft 42. The rotational speed of the coolant pump 10 is proportional to the rotational speed of the internal combustion engine. The coolant pump 10 can be directly mounted to the engine block.

The coolant pump is provided with a pump housing 12 housing the impeller pump wheel 40 pumping a liquid coolant incoming in axial direction radially into an outlet volute 13. Referring to FIGS. 1 to 6, the coolant inlet of the coolant pump 10 is provided at the bottom side of the coolant pump 10.

The pump housing 12 defines two separate pump outlets 14, 16 which respectively lead to two separate pump outlet openings. The first pump outlet 14 is accessible, coming from the outlet volute 13, through a valve opening 15, whereas the second pump outlet 16 is accessible through a separate opening 17 without any valve. The valve opening 15 and the opening 17 of the second pump outlet 16 define, as seen in a flow direction, the end of the outlet volute 13 and the beginning of the pump outlets 14, 16.

The two channels of the two pump outlets 14, 16 are separated from each other by a separation wall 60. The first pump outlet 14 is the main pump outlet and is, for example, directly connected with the engine block to cool the engine block. The second pump outlet 16 is smaller in cross section than the first pump outlet 14 and is connected to a secondary cooling object, for example, to an exhaust gas recirculation cooler. In the area right before the valve opening 15, an outlet valve arrangement is provided to control the coolant flow through the first outlet to the first pump outlet 14.

The outlet valve arrangement is provided with a single integral valve body 20 with a generally cylindrical basic geometry. The diameter of the virtual valve body cylinder is greater than the width of the valve opening 15. The axial end portions of the somehow cylindrical valve body 20 are defined by two end disks 28, 32 which are completely recessed in corresponding circular recesses 29, 33 of the pump housing 12. The valve body 20 is pivoted around a pivot axis 30 which is approximately the center axis of the virtual cylinder. The valve body 20 is actuated by a linear pneumatic actuator 38, via a lever arm 36 and a valve shaft 34 to be switched between an open valve position and a closed valve position.

Figure 4:
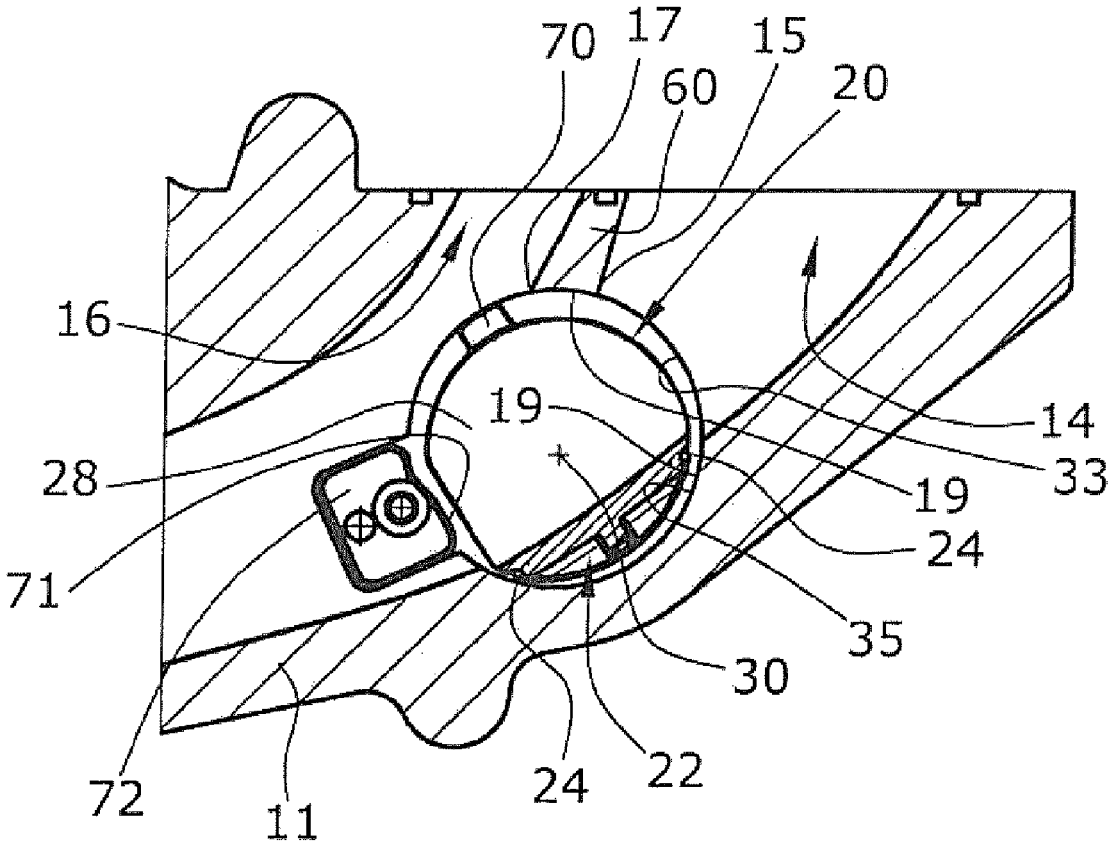
FIG. 4 shows a cross-section of the valve arrangement of FIG. 1 in the open valve position.
Figure 5:
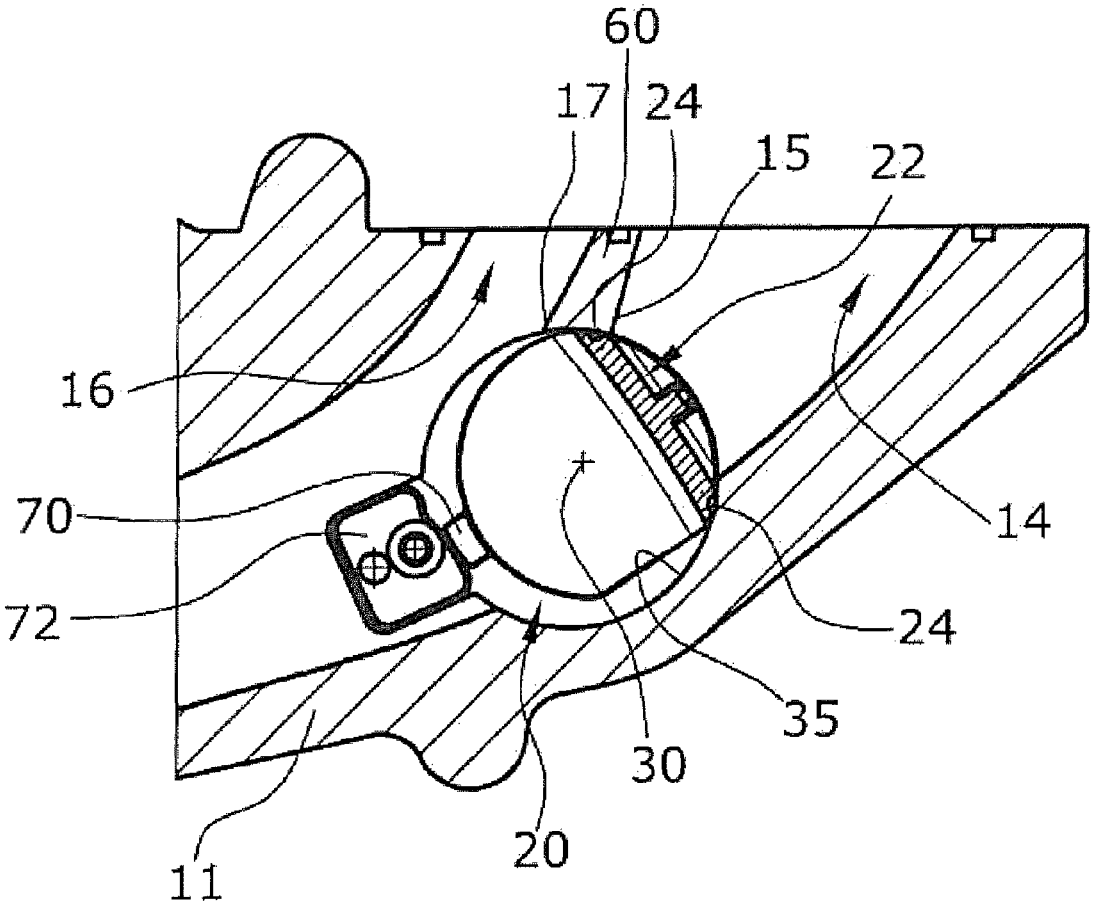
FIG. 5 shows a cross-section of the valve arrangement of FIG. 1 in the closed valve position.

The valve body 20, which can be made of metal, is provided with an integral closing element 22 which is defined by a single circle segment of the cylinder geometry defined by the end disks 28, 32 rotating around the pivot axis 30. As shown in FIG. 4, the closing element 22 of the valve body 20 is recessed in a corresponding recess 35 in a side wall 11 of the pump housing 12 in the open valve position so that a step-free sidewall is realized resulting in a low flow resistance. In the closed valve position shown in FIGS. 1, 3 and 5, the valve body 20 has been pivoted by about 90° with respect to the open valve position so that the closing element 22 of the valve body 20 is positioned in the valve opening 15 of the first pump outlet 14.

Both end disks 28,32 are provided with a radial clamping nose 70, 70' radially extending from the basic disk body of the respective end disk 28, 32. The clamping noses 70, 70' are not in direct contact with the pump housing 12 in the open valve position, but are in a radial contact with a corresponding support portion 71, 71' which is defined by a separate support element 72, 72' which is mounted to the pump housing 12. The support elements 72, 72' are made of a material which is harder than the housing material, and is, for example, made of steel, whereas the pump housing 12 is made of aluminium or plastic. The support elements 72, 72' are within a small range radially shiftable before they are fixed to the housing body by a screw.

Figure 6:
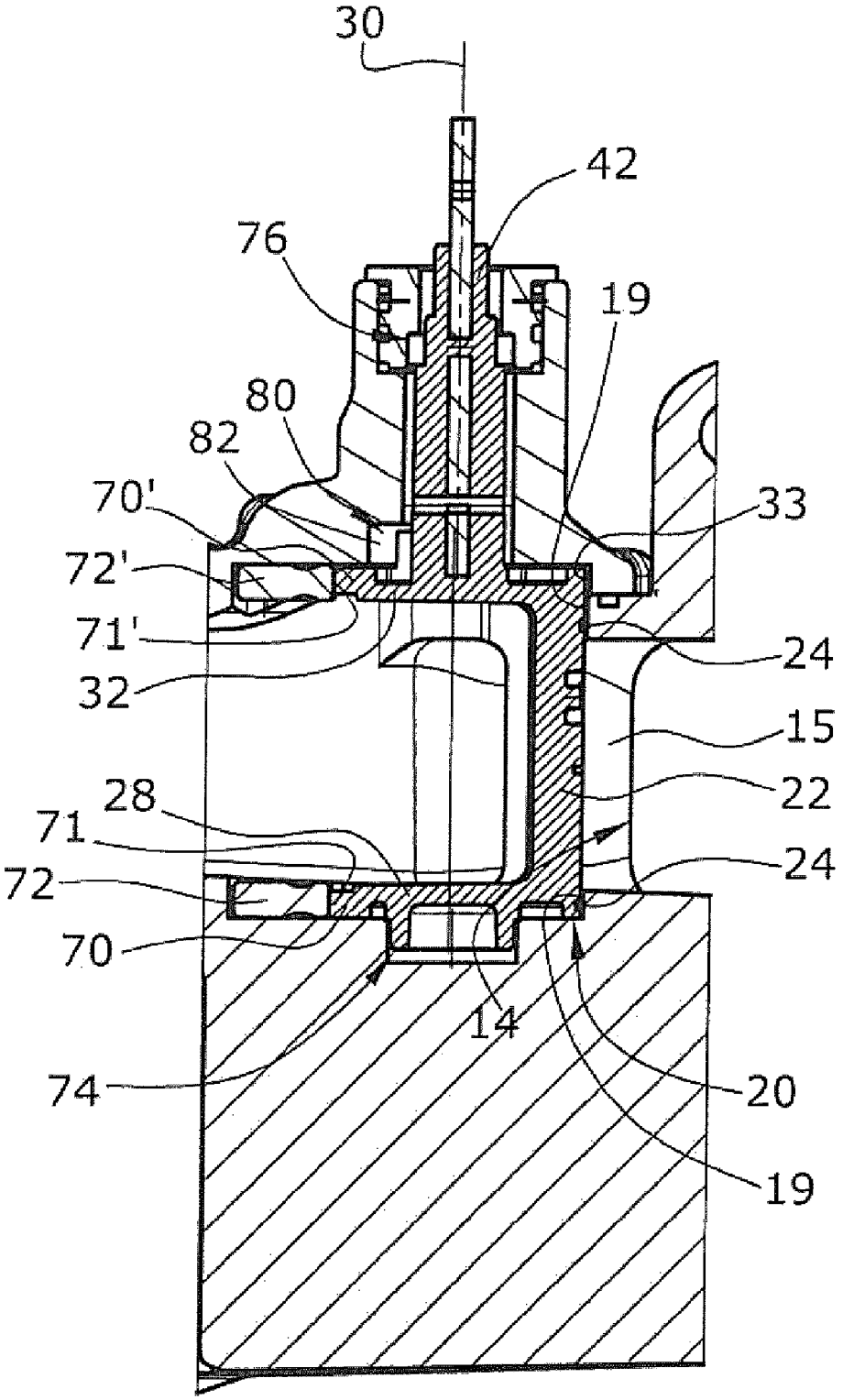
FIG. 6 shows a longitudinal section of the valve arrangement of FIG. 1 in the closed valve position.

As can be seen in FIG. 6, the valve body 20 is pivotably supported at the housing body by two slide bearings 74, 76 which are provided with a minimal radial play which allows the valve body 22 to minimally move in radial direction. The valve opening 15 defines a valve seat 19 on which the corresponding edge of the closing element 22 is seated in the closed valve position. An edge of the closing element 22 is provided with an elastic sealing member 24 which forms a closed loop and which improves the closing quality of the valve arrangement in the closed valve position.

In the closed valve position as shown in FIG. 6, the clamping noses 70, 70' are in contact with the corresponding support portions 71, 71' so that the complete valve body 20 is radially pushed away from the support portions 71, 71' to force the edge of the closing element 22, including the sealing member 24, against the valve seat 19.

The rotor shaft 42 is provided with an end stop arrangement 80 which defines the mechanical valve body pivot angle to about 90°. The end stop arrangement 80 comprises two stop elements 81, 81' at the rotor shaft 42 cooperating with a with one or two corresponding stop elements 82 at the pump housing body to define the mechanical pivot angle of the valve body 20.

The present invention is not limited to embodiments described herein; reference should be had to the appended claims.

What is claimed is:

1. A mechanical coolant pump for an internal combustion engine, the mechanical coolant pump comprising:

an outlet volute;

a pump outlet;

an impeller pump wheel configured to pump an incoming liquid coolant in an axial direction radially into the outlet volute to the pump outlet; and a pump housing defining the outlet volute, the pump housing comprising an outlet valve arrangement fluidically arranged between the outlet volute and the pump outlet and a support portion, the pump housing being configured to at least one of close and to open a valve opening, the outlet valve arrangement comprising a valve body configured to pivot, the valve body comprising, a closing element configured to directly cover the valve opening, the closing element comprising an opening seat in a closed valve position, and a first end disk and a second end disk configured to be parallel to each other and arranged at opposite axial ends of, and perpendicular to, the closing element, the first end disk and the second end disk being arranged so as to rotate around a pivot axis which is perpendicular to each of the first end disk and the second end disk, wherein, each of the first end disk and the second end disk comprises a radial clamping nose configured to act together with the support portion of the pump housing to radially push the closing element against the opening seat in a closed valve position.

2. The mechanical coolant pump as recited in claim 1, wherein each of the radial camping noses is arranged radially opposite to the closing element.

3. The mechanical coolant pump as recited in claim 1, wherein the support portion is defined by a separate support element mounted to the pump housing.

4. The mechanical coolant pump as recited in claim 3, wherein a radial position of the separate support element is provided so as to be adjustable with respect to the pump housing.

5. The mechanical coolant pump as recited in claim 1, further comprising a second pump outlet which is configured so that it is not closed by the closing element in the closed valve position.

6. The mechanical coolant pump as recited in claim 1, wherein the pump housing further comprises a first recess configured to recess the first end disk and a second recess configured to recess the second end disk.

7. The mechanical coolant pump as recited in claim 1, wherein the pivot axis is arranged within the outlet volute.

8. The mechanical coolant pump as recited in claim 1, wherein the pump housing further comprises a third recess configured to house the closing element in an open valve position.

9. The mechanical coolant pump as recited in claim 1, wherein the valve body further comprises a shaft, and further comprising an end stop arrangement comprising an end stop element arranged at the shaft.

* * * * *